US010908530B2

(12) United States Patent
Ogawa

(10) Patent No.: US 10,908,530 B2
(45) Date of Patent: Feb. 2, 2021

(54) IMAGE FORMING APPARATUS

(71) Applicant: KYOCERA Document Solutions Inc., Osaka (JP)

(72) Inventor: Kotaro Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/880,217

(22) Filed: May 21, 2020

(65) Prior Publication Data

US 2020/0379373 A1 Dec. 3, 2020

(30) Foreign Application Priority Data

May 28, 2019 (JP) ..... 2019-099368

(51) Int. Cl.
*G03G 15/08* (2006.01)

(52) U.S. Cl.
CPC ..... *G03G 15/0877* (2013.01)

(58) Field of Classification Search
CPC ..... G03G 15/0877
See application file for complete search history.

(56) References Cited

U.S. PATENT DOCUMENTS

2016/0084924 A1* 3/2016 Osumi ..... G01R 33/1223 324/236

FOREIGN PATENT DOCUMENTS

JP 2010026031 A 2/2010

* cited by examiner

*Primary Examiner* — Clayton E. LaBalle
*Assistant Examiner* — Michael A Harrison
(74) *Attorney, Agent, or Firm* — Alleman Hall Creasman & Tuttle LLP

(57) ABSTRACT

An image forming apparatus includes a developer case and a developer detection sensor. The developer case stores developer. The developer detection sensor is disposed in contact with a contacted portion that is located near the developer stored in the developer case, and the developer detection sensor detects magnetic permeability of the developer. The developer detection sensor includes a substrate and a plurality of contact portions. The plurality of contact portions are formed in a facing region on a first surface of the substrate that faces the contacted portion, and the plurality of contact portions are configured to come in contact with the contacted portion. A first contact portion that is one of the plurality of contact portions includes a detection portion that detects magnetism of the developer.

18 Claims, 15 Drawing Sheets

IMAGE FORMING APPARATUS

INCORPORATION BY REFERENCE

This application is based upon and claims the benefit of priority from the corresponding Japanese Patent Application No. 2019-099368 filed on May 28, 2019, the entire contents of which are incorporated herein by reference.

BACKGROUND

The present disclosure relates to an image forming apparatus that performs a developing process by using a developing device.

In an electrophotographic image forming apparatus such as a copier or a printer, a developing device develops an electrostatic latent image formed on a surface of a photoconductor drum that is an image carrier, thereby forming a toner image on a paper sheet. As a developing method adopted in the image forming apparatus, there is known a two-component developing method that uses a developer that includes toner and magnetic carrier that carries the toner. The developing device of the two-component developing method includes a developer detection sensor (toner sensor) for detecting concentration of toner, in order to prevent a toner shortage from occurring.

SUMMARY

An image forming apparatus according to an aspect of the present disclosure includes a developer case and a developer detection sensor. The developer case stores developer. The developer detection sensor is disposed in contact with a contacted portion that is located near the developer stored in the developer case, and the developer detection sensor detects magnetic permeability of the developer. The developer detection sensor includes a substrate and a plurality of contact portions. The plurality of contact portions are formed in a facing region on a first surface of the substrate that faces the contacted portion, and the plurality of contact portions are configured to come in contact with the contacted portion. A first contact portion that is one of the plurality of contact portions includes a detection portion that detects magnetism of the developer.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 100]

Figure 1:
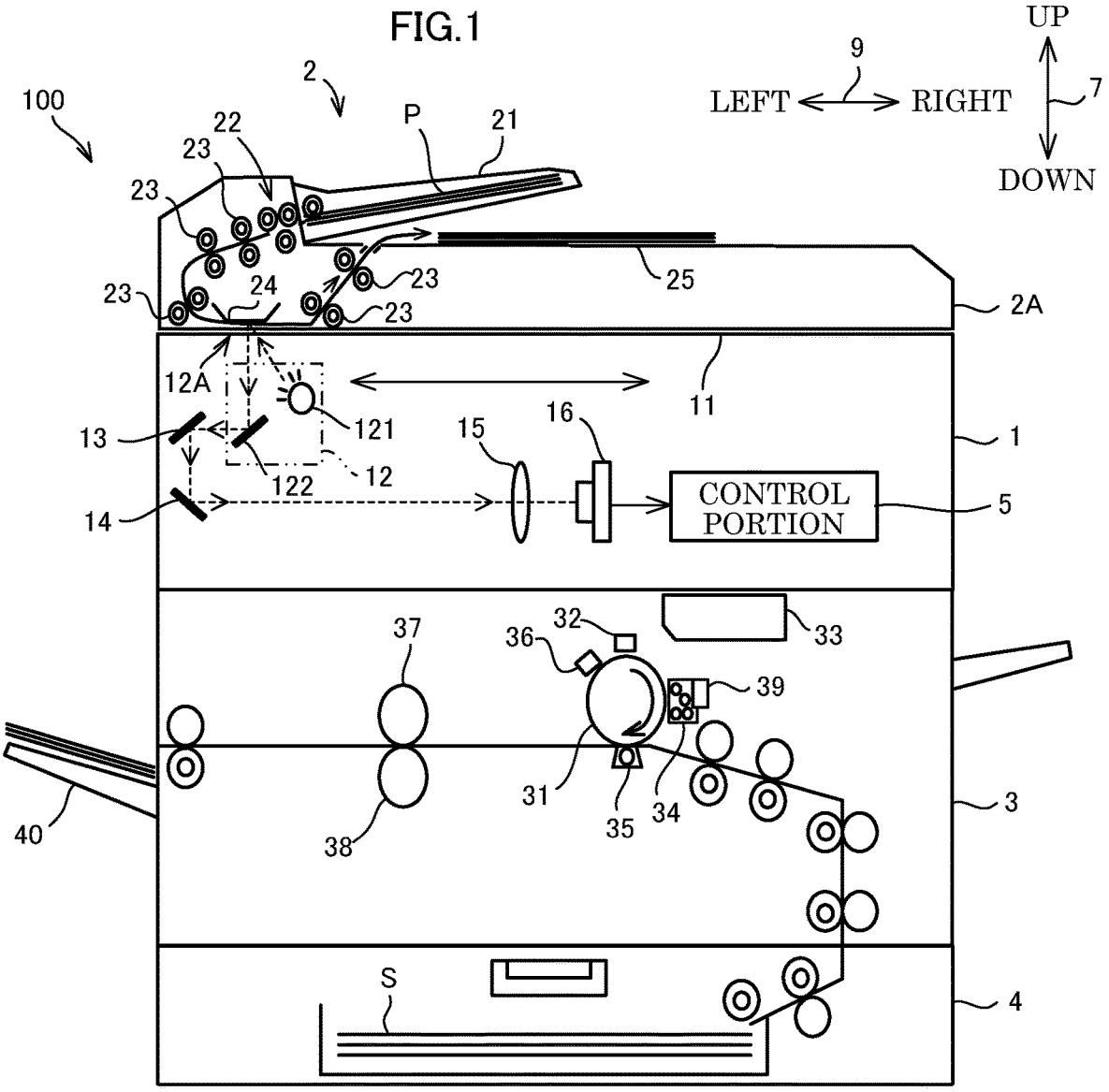
FIG. 1 is a diagram showing a configuration of an image forming apparatus according to an embodiment of the present disclosure.
Figure 2:
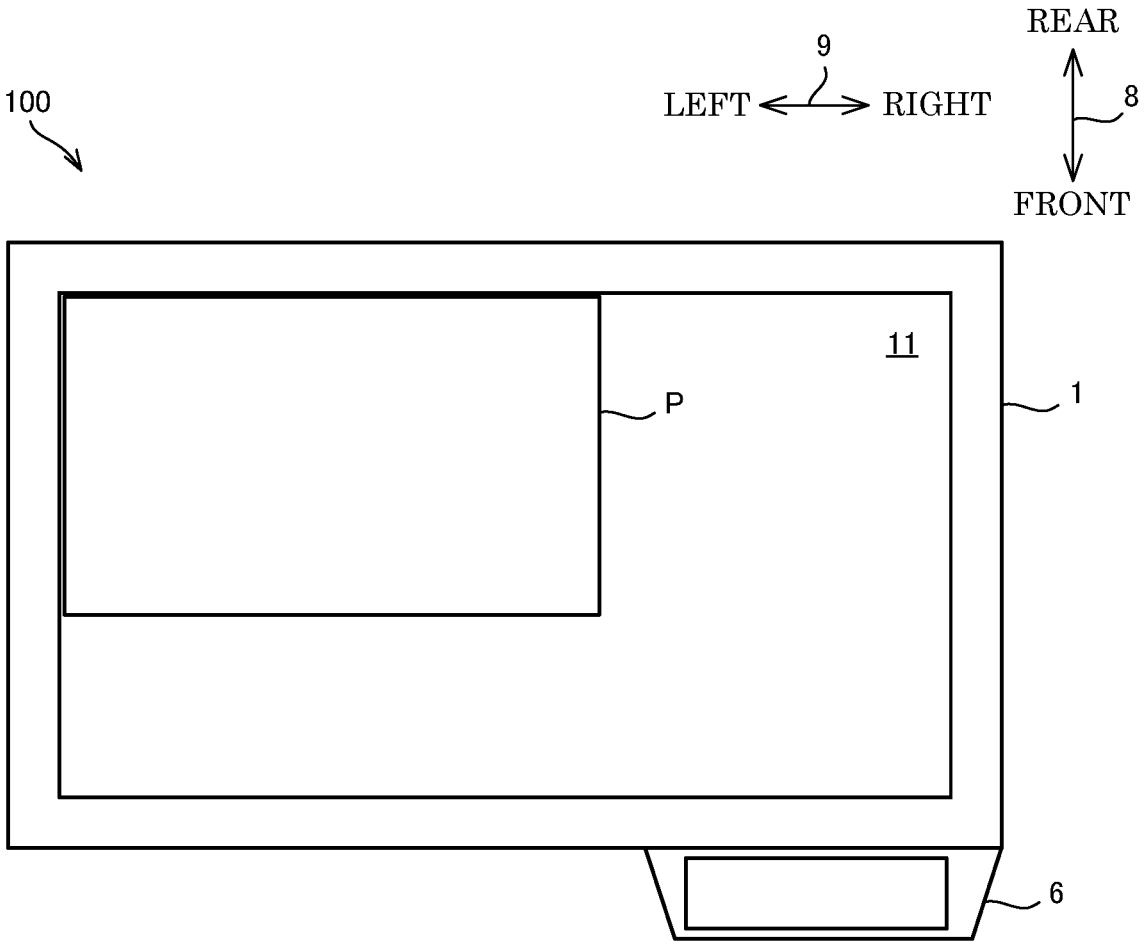
FIG. 2 is a plan diagram showing a configuration of the image forming apparatus according to the embodiment of the present disclosure.

First, a description is given of an approximate configuration of an image forming apparatus 100 according to an embodiment of the present disclosure. As shown in FIG. 1, the image forming apparatus 100 includes an image reading portion 1, an ADF (Automatic Document Feeder) 2, an image forming portion 3, a sheet feed portion 4, a control portion 5, and an operation/display portion 6. The operation/display portion 6 is, for example, a touch panel that displays various types of information in response to control instructions from the control portion 5, and inputs various types of information to the control portion 11 in response to user operations. FIG. 1 is a front diagram of the image forming apparatus 100, and FIG. 2 is a plan diagram of the image forming apparatus 100. It is noted that for the sake of explanation, an up-down direction 7 is defined as a vertical direction in a state where the image forming apparatus 100 is installed usably. In addition, a front-rear direction 8 is defined on the supposition that a side on which the operation/display portion 6 is provided is a front side (front). Furthermore, a left-right direction 9 is defined on the supposition that the side on which the operation/display portion 6 is provided is the front. In addition, the image forming apparatus 100 is only an example of the image forming apparatus of the present disclosure, and the image forming apparatus of the present disclosure may be a printer, a facsimile apparatus, or a copier.

The image reading portion 1 acquires image data from a paper sheet P. The image reading portion 1 is image reading means that includes a paper sheet cover 2A, a contact glass 11, a reading unit 12, a mirror 13, a mirror 14, an optical lens 15, and a CCD (Charge Coupled Device) 16. The contact glass 11 is a transparent paper sheet table which is provided on an upper surface of the image reading portion 1, and on which the paper sheet P that is the target of image reading of the image forming apparatus 100, is placed.

The paper sheet cover 2A covers the contact glass 11 as necessary. Controlled by the control portion 5, the image reading portion 1 reads an image from the paper sheet P placed on the contact glass 11.

The reading unit 12 includes an LED light source 121 and a mirror 122, and is configured to be moved in a sub scanning direction (the left-right direction 9 in FIG. 1) by a moving mechanism (not shown) such as a stepping motor. When the reading unit 12 is moved in the sub scanning direction by the moving mechanism, light that is emitted from the LED light source 121 toward the contact glass 11 is scanned in the sub scanning direction.

The LED light source 121 includes a lot of white LEDs that are arranged along a main scanning direction (the front-rear direction 8 in FIG. 1) of the image forming apparatus 100. The LED light source 121 emits one line of white light toward the paper sheet P positioned at a reading position 12A on the contact glass 11. It is noted that the reading position 12A moves in the sub scanning direction as the reading unit 12 moves in the sub scanning direction.

The mirror 122 reflects, toward the mirror 13, light that was emitted from the LED light source 121 and reflected from the paper sheet P positioned at the reading position 12A. The light reflected on the mirror 122 is guided by the mirror 13 and the mirror 14 into the optical lens 15. The optical lens 15 collects incident light and makes the collected light enter the CCD 16.

The CCD 16 is a photoelectric conversion element that converts received light into an electric signal (voltage) that corresponds to the light amount of the received light, and outputs the electric signal to the control portion 5. Specifically, the CCD 16 generates image data based on electric signals that correspond to the image of the paper sheet P, based on the light emitted from the LED light source 121 and reflected from the paper sheet P.

The ADF 2 is provided in the paper sheet cover 2A. The ADF 2 is an automatic document feeder that includes a paper sheet tray 21, a sheet feed mechanism 22, a plurality of conveyance rollers 23, a paper sheet pressing 24, and a sheet discharge portion 25. The ADF 2 drives the sheet feed mechanism 22 and the conveyance rollers 23 by a stepping motor (not shown) so that the paper sheet P set in the paper sheet tray 21 is conveyed to pass the reading position 12A on the contact glass 11 and conveyed to the sheet discharge portion 25. During this conveyance, the image reading portion 1 reads an image from the paper sheet P as it passes the reading position 12A.

The paper sheet pressing 24 is provided above the contact glass 11 at the reading position 12A with a sufficient interval for the paper sheet P to pass between them. The paper sheet pressing 24 is elongated in the main scanning direction, and a white sheet is stuck on a lower surface (a surface on the contact glass 11 side) of the paper sheet pressing 24. In the image forming apparatus 100, image data of the white sheet is read as white reference data. The white reference data is used in the well-known shading correction or the like.

The image forming portion 3 is an electrophotographic image forming means configured to execute an image forming process (print process) based on image data read by the image reading portion 1, or based on image data input from an external information processing apparatus such as a personal computer. The image forming portion 3 includes a photoconductor drum 31, a charging device 32, an LSU (Laser Scanner Unit) 33, a developing device 34 (an example of a developing device of the present disclosure), a transfer roller 35, an electricity removing device 36, a fixing roller 37, a pressure roller 38, and a toner container 39. In addition, the image forming portion 3 includes a stepping motor 77 (see FIG. 6) for supplying a rotational driving force to the developing device 34.

In the image forming portion 3, an image is formed on a paper sheet S fed from the sheet feed portion 4 by the following procedure, and the paper sheet S with the image formed thereon is discharged to a sheet discharge tray 40. Specifically, first, the charging device 32 uniformly charges the photoconductor drum 31 to a certain potential. Subsequently, the LSU 33 irradiates light on the surface of the photoconductor drum 41 based on the image data. In this processing, an electrostatic latent image is formed on a surface of the photoconductor drum 31. Subsequently, the electrostatic latent image on the photoconductor drum 31 is developed (visualized) as a toner image by the developing device 34 driven by the stepping motor 77. Subsequently, the toner image formed on the photoconductor drum 31 is transferred to the paper sheet S by the transfer roller 35. Subsequently, the toner image transferred to the paper sheet S is heated by the fixing roller 37 to be melted and fixed to the paper sheet S when the paper sheet S passes through between the fixing roller 37 and the pressure roller 38 and is discharged. The potential of the photoconductor drum 31 is removed by the electricity removing device 36. It is noted that the developing device 34 is described in detail below.

The sheet feed portion 4 feeds the paper sheet S so that an image is formed by the image forming portion 3. The sheet feed portion 4 feeds, one by one to the image forming portion 3, a plurality of paper sheets S placed on a sheet feed cassette (not shown) attached to a cassette attachment portion (not shown).

Next, the function of the control portion 5 is described with reference to FIG. 6. The control portion 5 includes a CPU 51, a ROM 52, a RAM 53, an EEPROM 54, and a motor driver 55. The control portion 5 comprehensively controls the image forming apparatus 100 by causing the CPU 51 to execute a predetermined control program stored in the ROM 52. Specifically, an image formation processing program, a driving control program and the like are preliminarily stored in the ROM 52, wherein the image formation processing program is for forming an image, and the driving control program is for driving the stepping motor 77 connected to the developing device 34.

The RAM 53 is a volatile storage means. The EEPROM 54 is a non-volatile storage means. The RAM 53 and the EEPROM 54 are used as temporary storage memories by various processes executed by the CPU 51. Controlled by the CPU 51, the motor driver 55 drives the stepping motor 77. In addition, the control portion 5 is connected with a toner sensor 80 included in the developing device 34, and an output signal (voltage signal) that is output from the toner sensor 80 upon detection is input to the control portion 5. The toner sensor 80 is described below. It is noted that the control portion 5 may be an electronic circuit such as an integrated circuit (ASIC, DSP), and may be a control portion provided independent of a main control portion that comprehensively controls the image forming apparatus 100.

[Configuration of Developing Device 34]

Figure 4:
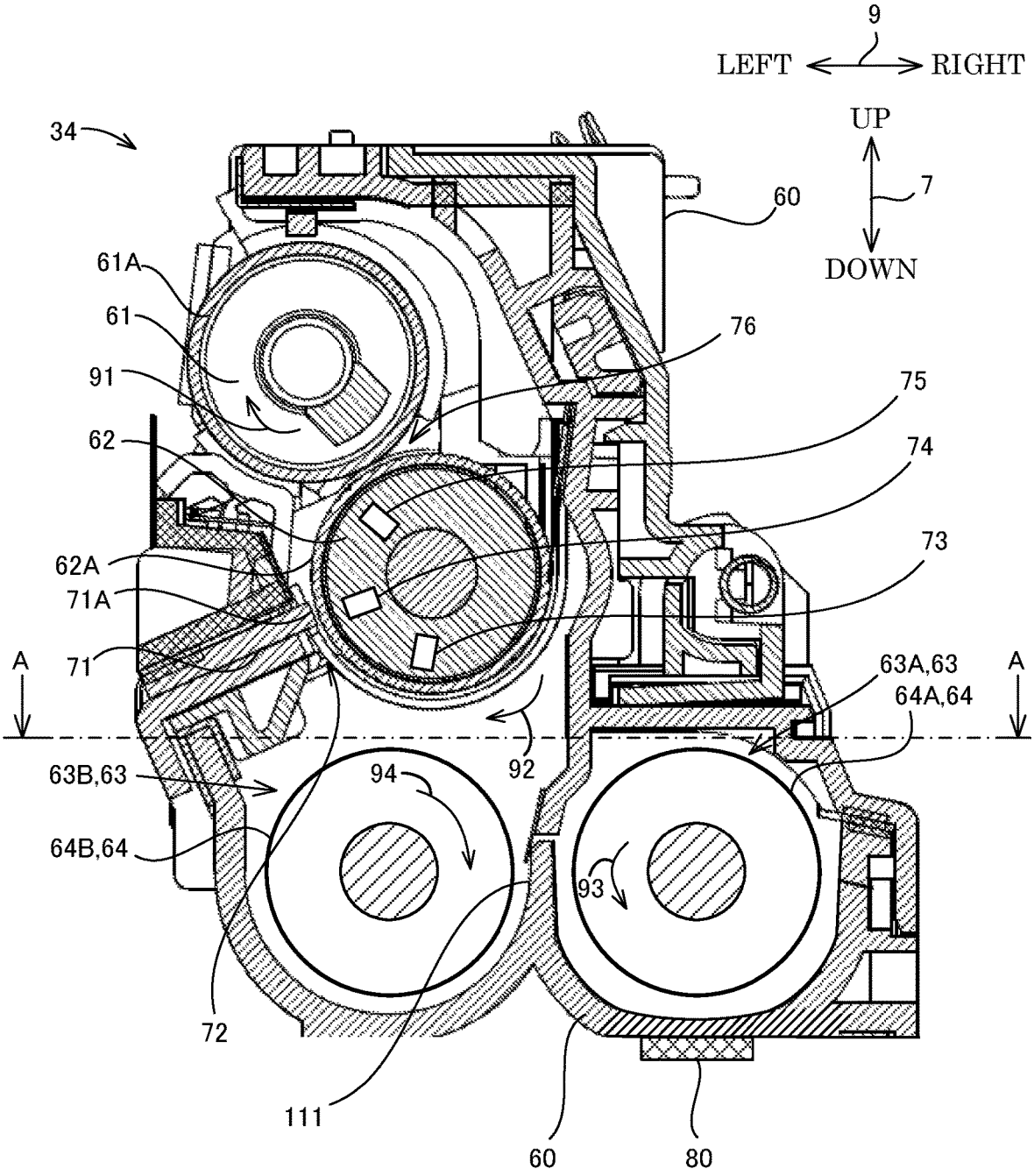
FIG. 4 is a cross-sectional diagram showing a configuration of the developing device according to the embodiment of the present disclosure.
Figure 5:
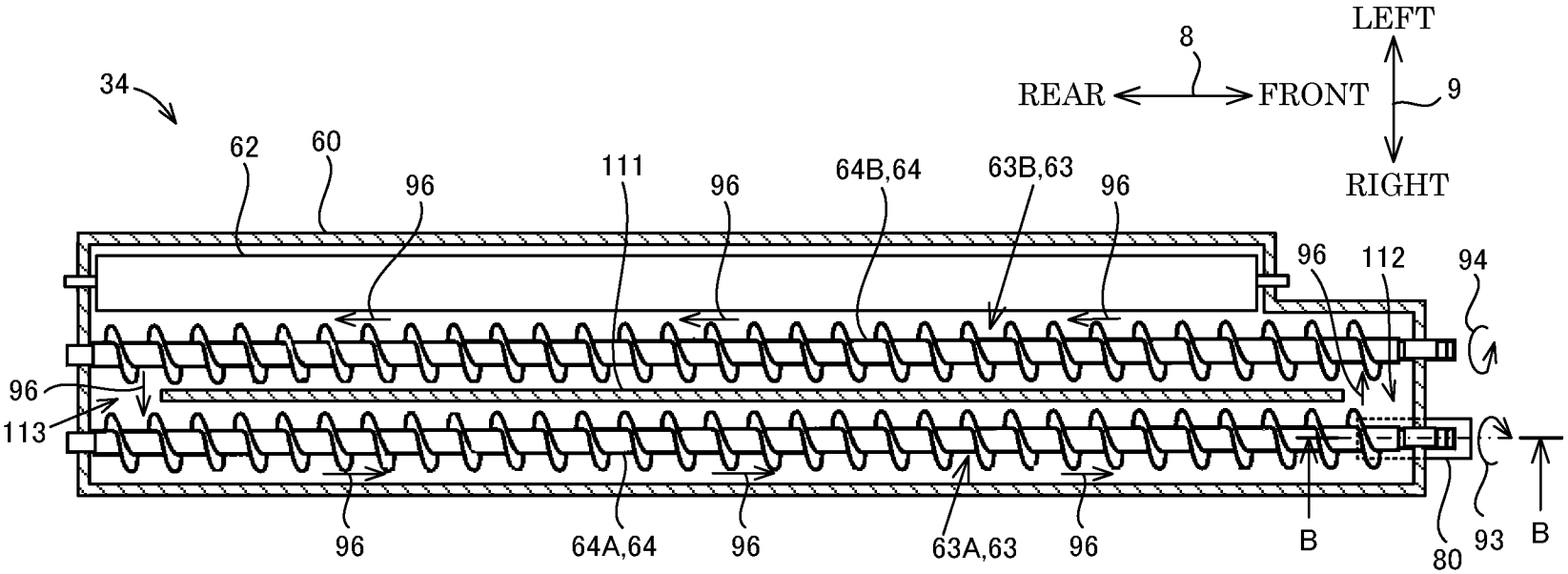
FIG. 5 is a cross-sectional diagram taken along an A-A line shown in FIG. 4.

Next, a specific configuration of the developing device 34 is described. FIG. 4 is a cross-sectional diagram showing a configuration of the developing device 34. FIG. 5 is a cross-sectional diagram taken along an A-A line shown in FIG. 4.

Figure 3:
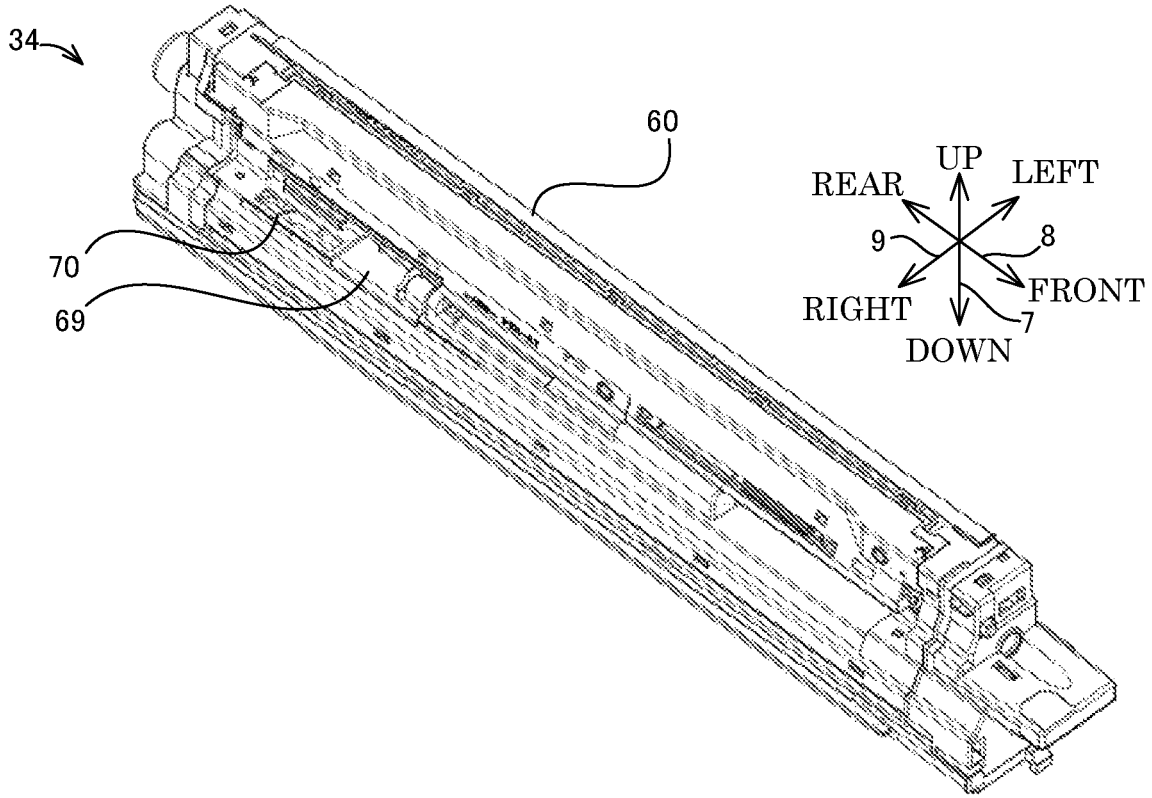
FIG. 3 is a perspective diagram showing a configuration of a developing device according to the embodiment of the present disclosure.

The developing device 34 performs developing by using what is called two-component developer composed of two components: toner; and carrier that has magnetism. As shown in FIG. 3, the developing device 34 is elongated in the front-rear direction 8. A supply port 70 is formed at an outer surface of the developing device 34, and a shutter 69 for opening and closing the supply port 70 is provided there, as well. The shutter 69 is slid by a solenoid (not shown) to open the supply port 70 when the non-magnetic toner is supplied from the toner container 39 (see FIG. 1) to the developing device 34. When the toner is not supplied, the shutter 69 is slid by the solenoid to close the supply port 70.

As shown in FIG. 4, the developing device 34 includes a developer reserving portion 63 (an example of a developer case of the present disclosure), a screw feeder 64A, a screw feeder 64B, a toner sensor 80 (an example of a developer detection sensor of the present disclosure), a developing roller 61, a magnetic roller 62, and a developer regulating blade 71. These components are provided inside a housing 60 of the developing device 34. The developer reserving portion 63 is formed integrally with the housing 60 at a bottom of the housing 60. The developer reserving portion 63 is a case for reserving (storing) the two-component developer supplied from the toner container 39, wherein the developer includes the non-magnetic toner and the magnetic carrier. The magnetic roller 62 that is a developer carrying member is disposed above the developer reserving portion 63. The developing roller 61 that is a toner carrying member is disposed diagonally above the magnetic roller 62 to face the magnetic roller 62. The developer regulating blade 71 is disposed to face the magnetic roller 62.

Figure 6:
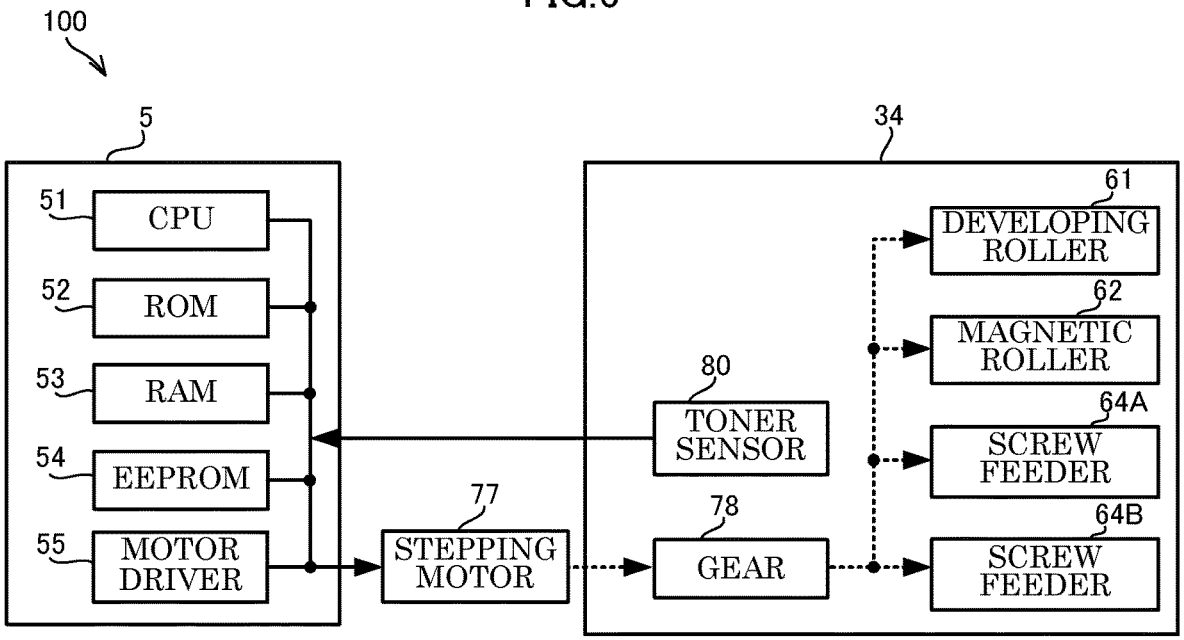
FIG. 6 is a block diagram showing a configuration of the image forming apparatus according to the embodiment of the present disclosure.

As shown in FIG. 6, the developing device 34 includes a gear 78. The developing roller 61, the magnetic roller 62, the screw feeder 64A, and the screw feeder 64B are coupled with an output shaft (not shown) of the stepping motor 77 via the gear 78. The rotational driving force supplied from the stepping motor 77 is transmitted to the developing roller 61, the magnetic roller 62, the screw feeder 64A, and the screw feeder 64B via the gear 78. This allows the screw feeder 64A, the screw feeder 64B, the developing roller 61, and the magnetic roller 62 to be rotated in conjunction with each other.

In the present embodiment, the developing device 34 is attached to the image forming portion 3 in a detachable manner. The image forming portion 3 executes a developing process and an image forming process by using the attached developing device 34. For example, when the developing device 34 is failed due to a damage of the gear 78 or a rotational defect of the developing roller 61, the magnetic roller 62, the screw feeder 64A, or the screw feeder 64B, the developing device 34 can be detached and replaced with a new one.

When developing is performed, the stepping motor 77 is controlled by the control portion 5 to cause the developing roller 61 and the magnetic roller 62 to rotate in their normal rotational directions (directions indicated by arrows 91 and 92 in FIG. 4). In conjunction with this, the screw feeder 64A and the screw feeder 64B are caused by the gear 78 to rotate in predetermined normal rotational directions (directions indicated by arrows 93 and 94 in FIG. 4 and FIG. 5). This allows the toner to be supplied to the photoconductor drum 31. In addition, when the developing is not performed, the stepping motor 77 is controlled by the control portion 5 to cause the developing roller 61 and the magnetic roller 62 to rotate in their reverse rotational directions (directions reverse to the directions of the arrows 91 and 92 in FIG. 4) that are reverse to the normal rotational directions. In conjunction with this, the screw feeder 64A and the screw feeder 64B are caused by the gear 78 to rotate in predetermined reverse rotational directions (directions reverse to the directions of the arrows 93 and 94 in FIG. 4 and FIG. 5). This makes it possible to stir the toner that is stagnating or precipitated at a place where the toner cannot be stirred by the components rotated in the normal rotational direction.

As shown in FIG. 5, the developer reserving portion 63 includes two adjacent developer reserving portions 63A and 63B that extend in the longitudinal direction of the developing device 34 (the front-rear direction 8). Each of the developer reserving portions 63A and 63B is formed in the shape of a cylinder elongated in the front-rear direction 8. The developer reserving portions 63A and 63B are integrally formed with the housing 60 and are separated from each other by a separating plate 111 extending in the front-rear direction 8. However, they are not completely separated from each other since, as shown in FIG. 5, the separating plate 111 is not present at opposite ends in the front-rear direction 8. Specifically, the developer reserving portions 63A and 63B are communicated with each other at the opposite ends thereof by communication paths 112 and 113.

The screw feeder 64A and the screw feeder 64B are respectively stored in the developer reserving portions 63A and 63B. The screw feeder 64A and the screw feeder 64B are formed from a synthetic resin. The screw feeder 64A is rotatably supported by walls of the developer reserving portion 63A at opposite ends thereof in the longitudinal direction. In addition, the screw feeder 64B is rotatably supported by walls of the developer reserving portion 63B at opposite ends thereof in the longitudinal direction. This allows the screw feeders 64A and 64B to rotate respectively inside the developer reserving portions 63A and 63B. Rotated around the shaft inside the developer reserving portions 63A and 63B, the screw feeders 64A and 64B convey the developer while stirring it. Each of the screw feeders 64A and 64B has a spiral blade around the shaft. Upon receiving a rotational driving force supplied from the stepping motor 77 via the gear 78, the screw feeders 64A and 64B rotate. The screw feeders 64A and 64B are set to rotate in directions reverse to each other. This allows the developer to be cyclically conveyed, while being stirred, in the developer reserving portion 63 and the developer reserving portion 63B in a direction indicated by arrows 96 in FIG. 5. This stirring allows the toner of the developer to have electric charges.

As shown in FIG. 5, the toner sensor 80 (an example of a developer detection sensor of the present disclosure) is disposed near an end (a front end) of the developer reserving portion 63A (an example of a developer case of the present disclosure). The toner sensor 80 is disposed in contact with a contacted portion that is located near the developer stored in the developer reserving portion 63A, and configured to detect magnetic permeability of the developer. As described below, for example, the toner sensor 80 is disposed and fixed such that a first contact portion 86A and a second contact portion 86B formed on a surface (an example of a first surface of the present disclosure) of a substrate 81 come in contact with a bottom surface (an outer surface) of the developer reserving portion 63A (an example of a contacted portion of the present disclosure) (see FIG. 7A and FIG. 7B). The bottom surface of the developer reserving portion 63A is formed in the shape of a flat surface (to be flat) so as to be in surface contact with the toner sensor 80. It is noted that the toner sensor 80 may be fixed by being pressed against the bottom surface of the developer reserving portion 63A via an elastic member such as sponge or rubber.

The magnetic roller 62 (see FIG. 5) is disposed along the longitudinal direction (the front-rear direction 8) of the developing device 34. The magnetic roller 62 is rotated clockwise in FIG. 4 (in a direction indicated by arrow 92 in FIG. 4) during developing. A fixed, what is called magnetic roll (not shown) is provided inside the magnetic roller 62. The magnetic roll includes a plurality of magnetic poles that are, in the present embodiment, a draw-up pole 73, a regulation pole 74, and a main pole 75. The draw-up pole 73 is disposed to face the developer reserving portion 63, the regulation pole 74 is disposed to face the developer regulating blade 71, and the main pole 75 is disposed to face the developing roller 61.

The magnetic roller 62 magnetically draws up the developer by the magnetic force of the draw-up pole 73, from the developer reserving portion 63 onto a magnetic roller peripheral surface 62A of the magnetic roller 62. The drawn-up developer is magnetically held as a developer layer (magnetic brush layer) on the magnetic roller peripheral surface 62A, and is conveyed toward the developer regulating blade 71 as the magnetic roller 62 rotates.

The developer regulating blade 71 is disposed upstream of the developing roller 61 in the rotation direction of the magnetic roller 62. The developer regulating blade 71 regulates the layer thickness of the developer layer that has magnetically adhered to the magnetic roller peripheral surface 62A. The developer regulating blade 71 is a plate member formed from a magnetic material to extend along the front-rear direction 8 of the magnetic roller 62, and is attached to the housing 60. In addition, the developer regulating blade 71 includes a regulation surface 71A (namely, a front-end surface of the developer regulating blade 71), wherein a regulation gap 72 of a predetermined size is formed between the regulation surface 71A and the magnetic roller peripheral surface 62A.

The developer regulating blade 71 is formed from a magnetic material, and is magnetized by the regulation pole 74 of the magnetic roller 62. This allows a magnetic path to be formed between the regulation surface 71A of the developer regulating blade 71 and the regulation pole 74, namely, in the regulation gap 72. When the developer layer that has been adhered to the magnetic roller peripheral surface 62A by the draw-up pole 73 is conveyed into the regulation gap 72 by the rotation of the magnetic roller 62, the layer thickness of the developer layer is regulated in the regulation gap 72. This allows a developer layer of a uniform, predetermined thickness to be formed on the magnetic roller peripheral surface 62A.

The developing roller 61 is provided to extend in the longitudinal direction of the developing device 34 (in the front-rear direction 8) in parallel to the magnetic roller 62. The developing roller 61 is rotated clockwise in FIG. 4 (in a direction indicated by arrow 91 in FIG. 4) during developing. The developing roller 61 is rotated in a state of being in contact with the developer layer held on the magnetic roller peripheral surface 62A, receives the toner from the developer layer, and carries a toner layer on a developing roller peripheral surface 61A. When the developing is performed, the toner of the toner layer is supplied to the peripheral surface of the photoconductor drum 31.

The developing roller 61 and the magnetic roller 62 are rotated by the stepping motor 77. A gap 76 (see FIG. 4) of a predetermined size is formed between the developing roller peripheral surface 61A and the magnetic roller peripheral surface 62A. For example, the gap 76 is set to approximately 130 μm. The developing roller 61 is disposed to face the photoconductor drum 31 through an opening formed in the housing 60. In addition, a gap of a predetermined size (for example, approximately 110 μm) is formed between the developing roller peripheral surface 61A and the peripheral surface of the photoconductor drum 31.

The toner sensor 80 detects concentration of the toner included in the developer reserved in the developer reserving portion 63A. Specifically, the toner sensor 80 measures the magnetic permeability of the developer based on the magnetism that is received by a coil 82 (described below) from the toner, and detects the concentration of the toner based on a voltage corresponding to the magnetic permeability. When the toner is consumed by the developing, the ratio (percentage) of the toner to the developer changes, and thereby the magnetic permeability of the developer changes. For example, when the ratio of the toner to the developer decreases, the magnetic permeability of the developer increases, and the voltage level increases. The toner sensor 80 determines the concentration of the toner in the developer based on the voltage level corresponding to the detected magnetic permeability. The toner sensor 80 outputs the detected concentration of the toner to the control portion 5. It is noted that the toner sensor 80 may output, to the control portion 5, a voltage corresponding to the detected magnetic permeability, as an output signal (voltage signal). In this case, the control portion 5 determines the concentration of the toner in the developer based on the output signal that has been input.

The concentration of the toner changes as the remaining amount of the toner changes. As a result, the control portion 5 can detect the remaining amount of the toner contained in the developer reserved in the developer reserving portion 63A, based on the concentration of the toner detected by the toner sensor 80. That is, the control portion 5 acquires the concentration of the toner in the developer (the magnetic permeability) detected by the toner sensor 80, and detects the remaining amount of the toner in the developer based on the acquired concentration of the toner in the developer. In addition, when the detected remaining amount of the toner becomes smaller than a predetermined amount, the control portion 5 slides the shutter 69 to open the supply port 70 and supplies the toner from the toner container 39 to the developing device 34. In this way, the control portion 5 performs a control such that the concentration of the toner in the developer in the developing device 34 is kept to be within a predetermined range.

Figure 7A:
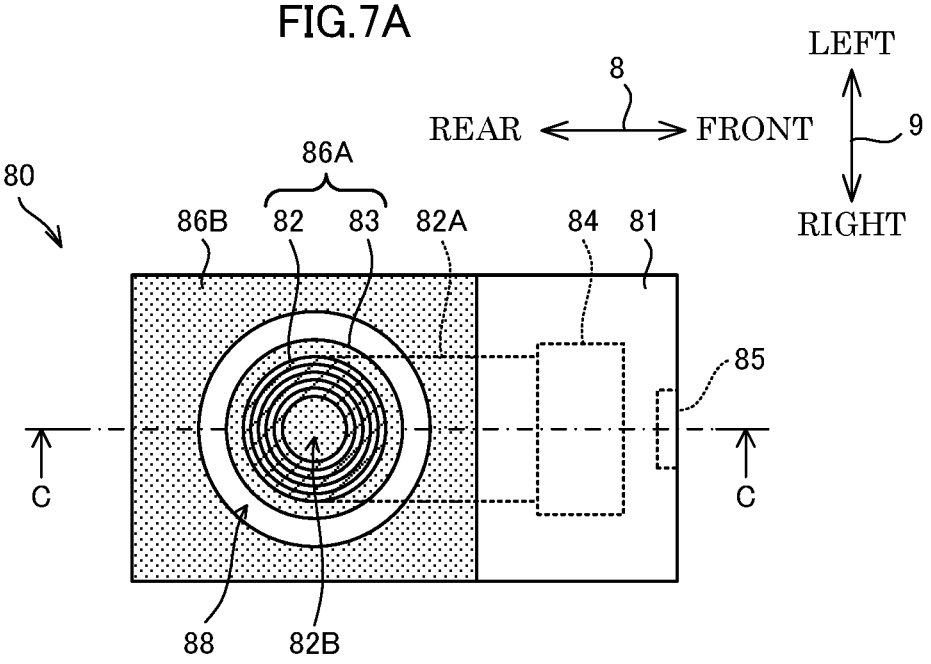
FIG. 7A is a plan diagram showing a configuration of a toner sensor according to the embodiment of the present disclosure.
Figure 7B:
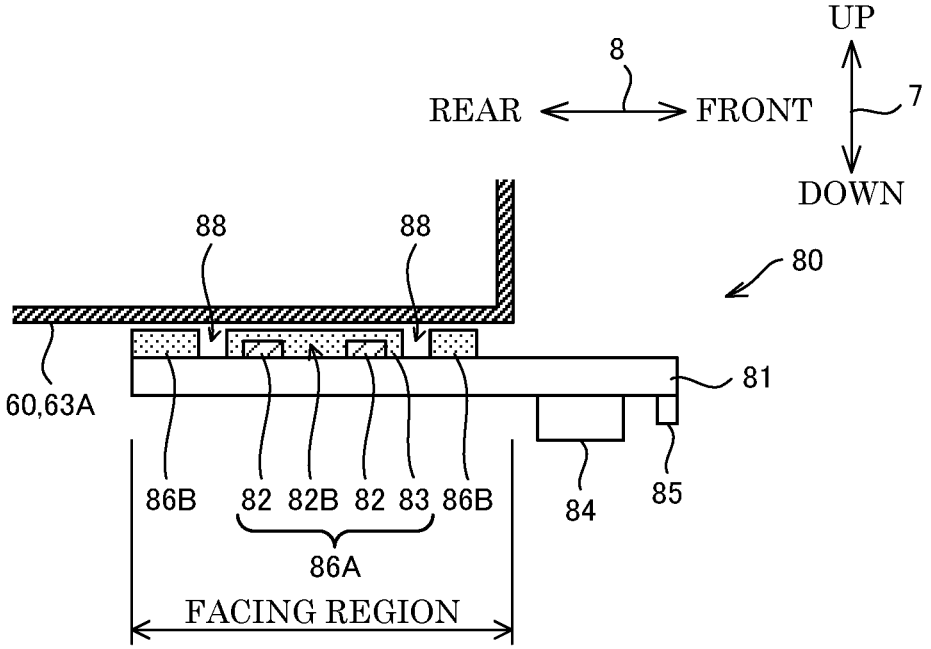
FIG. 7B is a cross-sectional diagram taken along a C-C line shown in FIG. 7A.

FIG. 7A is a plan diagram showing a configuration of the toner sensor 80 according to the present embodiment. FIG. 7B is a cross-sectional diagram taken along a C-C line shown in FIG. 7A, and is a cross-sectional diagram taken along a B-B line shown in FIG. 5. The toner sensor 80 is formed on a front surface (a first surface) of the substrate 81 facing the developer reserving portion 63A (an example of a contacted portion of the present disclosure), and includes a plurality of contact portions that come in contact with the developer reserving portion 63A. Specifically, as shown in FIG. 7A and FIG. 7B, the toner sensor 80 includes the substrate 81, a coil 82, a protective film 83, a circuit portion 84, a connector portion 85, and the second contact portion 86B. The coil 82 and the protective film 83 constitute one contact portion (the first contact portion 86A), and the second contact portion 86B constitutes one contact portion. The first contact portion 86A is an example of a first contact portion of the present disclosure, and the second contact portion 86B is an example of a second contact portion of the present disclosure. The number of the contact portions is not limited to a certain number as far as two or more contact portions are provided.

The substrate 81 is formed from, for example, glass epoxy, and formed in a rectangular shape in a plan view. The substrate 81 has a long side of approximately 30 to 50 mm, a short side of approximately 20 to 30 mm, and a thickness of approximately 1 to 1.6 mm in size.

The coil 82 is a detection portion composed of a spiral, planar coil formed as a wiring pattern on the front surface (the first surface) of the substrate 81. The coil 82 is configured to detect the magnetism of the developer (toner). The coil 82 is an example of a detection portion of the present disclosure. The coil 82 is formed on the substrate 81 such that, for example, the thickness is 18 to 35 μm, the diameter of the spiral portion is 10 to 15 mm, and the center axis line of the spiral portion extends in parallel to the normal direction of the front surface of the substrate 81. It is noted that although in the present embodiment, the coil 82 is formed on one surface of the substrate 81, the coil 82 may be formed on both surfaces of the substrate 81: the front surface (the first surface); and a back surface (a second surface). In addition, the substrate 81 may be formed inside the substrate 81.

The protective film 83 is formed from an insulating resin, and is formed to cover the coil 82 on the front surface of the substrate 81. The thickness (height) of the protective film 83 is, for example, approximately 40 μm.

The circuit portion 84 is a control circuit configured to receive the signal detected by the coil 82, is disposed on the back surface of the substrate 81, and is electrically connected to the coil 82 via a wiring 82A. The circuit portion 84 includes, for example, an application circuit and a signal processing circuit, wherein the application circuit applies a pulse signal to the coil 82, and the signal processing circuit processes an output signal from the coil 82 and determines the concentration of the toner based on a voltage corresponding to the magnetic permeability. It is noted that in the toner sensor 80, the circuit portion 84 may be provided outside the substrate 81, and only the coil 82 may be provided on the substrate 81. Furthermore, the substrate 81 includes the connector portion 85 for supplying electricity from outside to the circuit portion 84. In addition, the toner sensor 80 is electrically connected to the control portion 5 via the connector portion 85, and outputs the detected concentration of the toner to the control portion 5.

Figure 8A:
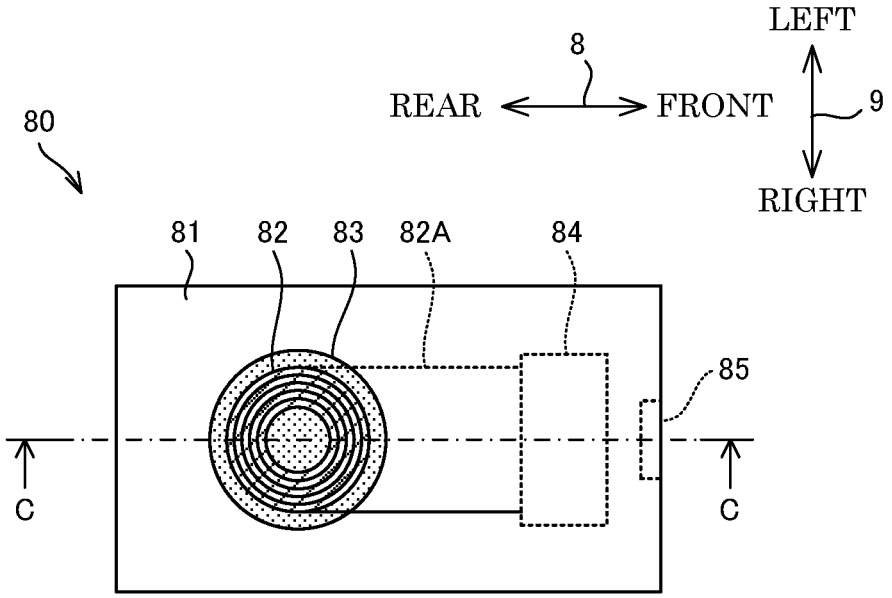
FIG. 8A is a plan diagram showing a configuration of a toner sensor for reference.
Figure 8B:
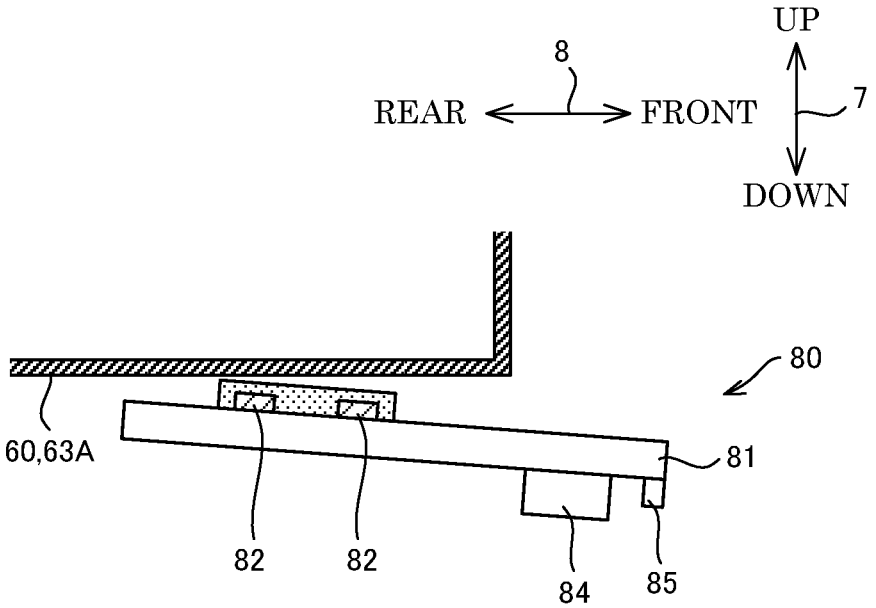
FIG. 8B is a cross-sectional diagram taken along a C-C line shown in FIG. 8A.

FIG. 8A and FIG. 8B show a configuration of the toner sensor 80 for reference. FIG. 8A is a plan diagram showing the configuration of the toner sensor 80 for reference. FIG. 8B is a cross-sectional diagram taken along a C-C line shown in FIG. 8A. As shown in FIG. 8B, in a case where the toner sensor 80 is fixed in a state of being in contact with the housing 60 (for example, the bottom surface of the developer reserving portion 63A), a position of the toner sensor 80 in the up-down direction 7 may not be stabilized due to a step between the coil 82 and the protective film 83, and the toner sensor 80 may be inclined with respect to the housing 60, with the step as a fulcrum. When the toner sensor 80 is inclined with respect to the housing 60, the distance between the coil 82 of the toner sensor 80 and the developing device 34 changes, and the detection values of the toner sensor 80 are varied. This makes it difficult to detect the concentration of the toner accurately.

In view of the above-mentioned problem, the toner sensor 80 according to the present embodiment includes, in a facing region on a surface of the substrate 81, a plurality of contact portions that come in contact with a contacted portion (for example, the developer reserving portion 63A). In addition, the plurality of contact portions have a same height from the front surface of the substrate 81. Specifically, as shown in FIG. 7B, the toner sensor 80 includes the first contact portion 86A (an example of a first contact portion of the present disclosure) and the second contact portion 86B (an example of a second contact portion of the present disclosure) in the facing region on the front surface of the substrate 81 that faces the housing 60 (for example, the developer reserving portion 63A), wherein the first contact portion 86A is composed of the coil 82 and the protective film 83, and the second contact portion 86B has the same height as the first contact portion 86A and is configured to keep the distance between the toner sensor 80 and the housing 60 (the developer reserving portion 63A). The second contact portion 86B is, for example, formed from the same material as the protective film 83, and formed in the same manufacturing process (that is described below) as the protective film 83.

In addition, as shown in FIG. 7A, in a plan view, the second contact portion 86B is formed to surround the first contact portion 86A at a certain interval. That is, an annular gap 88 is formed between the first contact portion 86A and the second contact portion 86B.

The facing region is a region (a pressing region) where a pressing force acts on the toner sensor 80 when the toner sensor 80 is fixed in a state of being in contact with the housing 60 (the developer reserving portion 63A), and is a region where the bottom surface of the developer reserving portion 63A overlaps with the toner sensor 80 in a plan view. The second contact portion 86B is at least formed in the facing region, but may be formed to extend out the facing region on the substrate 81.

With the configuration shown in FIG. 7A and FIG. 7B in which the toner sensor 80 is fixed in a state of being in contact with the housing 60 at a plurality of portions (the first contact portion 86A, the second contact portion 86B), it is possible to prevent the toner sensor 80 from being shifted (inclined) in the up-down direction 7. In addition, since the second contact portion 86B that is disposed, via the gap 88, independently of the first contact portion 86A that includes the coil 82, comes in contact with the housing 60, even in a case where, for example, deformation such as warp occurs to the substrate 81, the deformation is absorbed by the gap 88. As a result, the toner sensor 80 is fixed to the housing 60 (the developer reserving portion 63A) in a reliable manner by the plurality of contact portions. This makes it possible to restrict the detection values of the toner sensor 80 from varying, and detect the concentration of the toner accurately. It is noted that the toner sensor 80 may be fixed, by screws or the like, to another part such as a cover of the toner sensor 80.

The toner sensor according to the present disclosure is not limited to the configuration shown in FIG. 7A and FIG. 7B. The following describes another embodiment of the toner sensor 80.

Figure 9A:
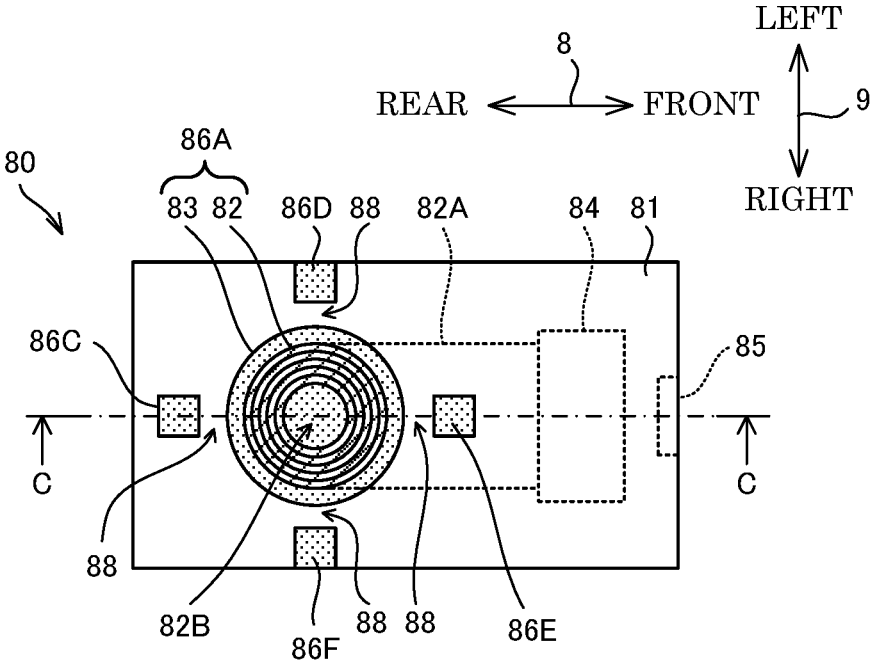
FIG. 9A is a plan diagram showing a configuration of the toner sensor according to the embodiment of the present disclosure.
Figure 9B:
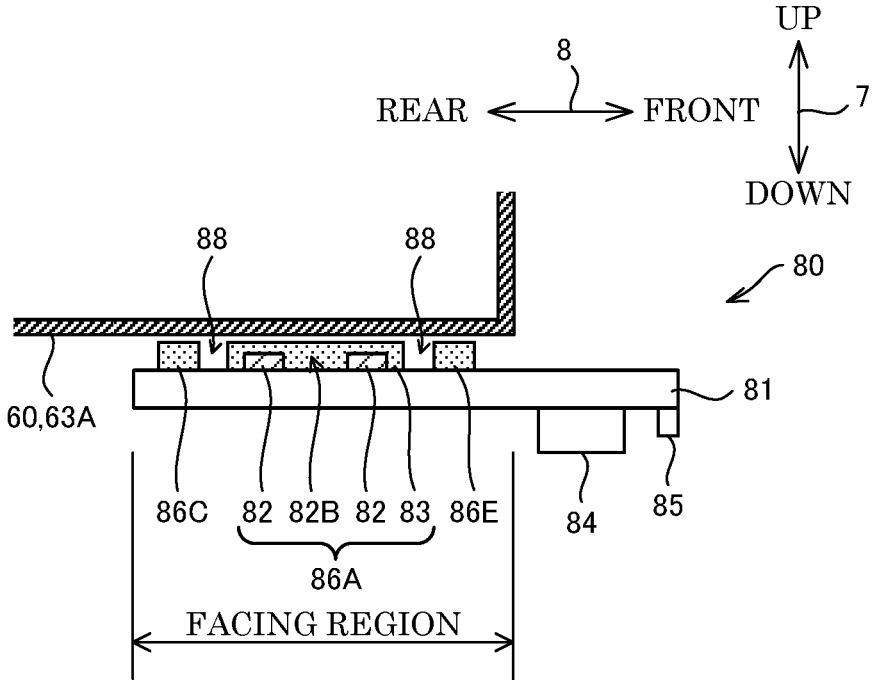
FIG. 9B is a cross-sectional diagram taken along a C-C line shown in FIG. 9A.

FIG. 9A is a plan diagram showing a configuration of the toner sensor 80 according to a modification. FIG. 9B is a cross-sectional diagram taken along a C-C line shown in FIG. 9A. As shown in FIG. 9A and FIG. 9B, the toner sensor 80 according to the modification includes a plurality of independent second contact portions on the front surface (the first surface) of the substrate 81 in the facing region of the toner sensor 80. In the present example, the toner sensor 80 includes four second contact portions 86C, 86D, 86E, and 86F. The second contact portions 86C, 86D, 86E, and 86F have the same height as the first contact portion 86A. In FIG. 9A, a plan view, the second contact portion 86C is arranged on the left of the first contact portion 86A, the second contact portion 86D is arranged above the first contact portion 86A, the second contact portion 86E is arranged on the right of the first contact portion 86A, and the second contact portion 86F is arranged below the first contact portion 86A. The second contact portion 86C and the second contact portion 86E are arranged such that the center of a straight line connecting the second contact portion 86C and the second contact portion 86E matches the center of the first contact portion 86A. In addition, the second contact portion 86D and the second contact portion 86F are arranged such that the center of a straight line connecting the second contact portion 86D and the second contact portion 86F matches the center of the first contact portion 86A. In addition, the second contact portions 86C, 86D, 86E, and 86F are formed with a predetermined interval (the gap 88) from the first contact portion 86A.

With the configuration shown in FIG. 9A and FIG. 9B in which the toner sensor 80 is fixed in a state of being in contact with the housing 60 (the developer reserving portion 63A) at more independent portions (the first contact portion 86A, and the second contact portions 86C, 86D, 86E, and 86F), it is possible to prevent the toner sensor 80 from being shifted in the up-down direction 7 in a reliable manner. It is noted that the number, arrangement positions, and shapes of the second contact portions are not limited to those of the above-described configuration.

[Manufacturing Method of Toner Sensor 80]

Next, a manufacturing method of the toner sensor 80 is described. FIG. 10A to FIG. 10F show an example of a manufacturing method of the toner sensor 80. It is supposed here that the toner sensor 80 shown in FIG. 7A and FIG. 7B is manufactured.

Figure 10A:
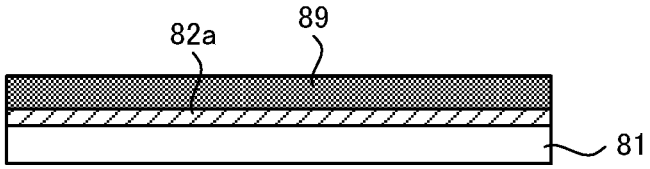
FIG. 10A is a cross-sectional diagram showing a first step of a manufacturing method of the toner sensor according to the embodiment of the present disclosure.

First, in a first step shown in FIG. 10A, a resist film 89 is formed by forming a copper film 82*a*, as the material of the coil 82, on the front surface (the first surface) of the substrate 81, and applying a photosensitive resist (a photosensitive resin) on the copper film 82*a*.

Figure 10B:
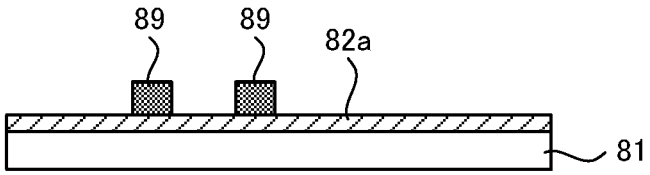
FIG. 10B is a cross-sectional diagram showing a second step of the manufacturing method of the toner sensor according to the embodiment of the present disclosure.

Subsequently, in a second step shown in FIG. 10B, a photo mask is used to transfer a pattern to the resist film 89 by the photolithography technique. The pattern corresponds to a pattern (for example, a spiral pattern) of the coil 82.

Figure 10C:
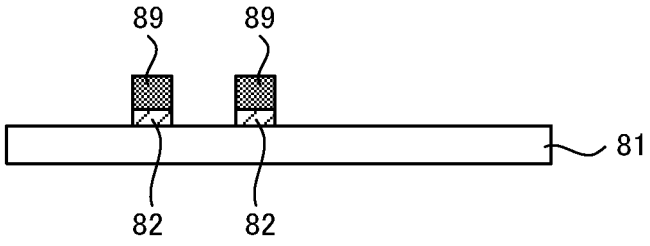
FIG. 10C is a cross-sectional diagram showing a third step of the manufacturing method of the toner sensor according to the embodiment of the present disclosure.

Subsequently, in a third step shown in FIG. 10C, the resist film 89 is masked, and portions of the copper film 82*a* that are not protected by the resist film 89 are removed (etched) by ionic gas having a strong anisotropy. This forms the spiral coil 82.

Figure 10D:
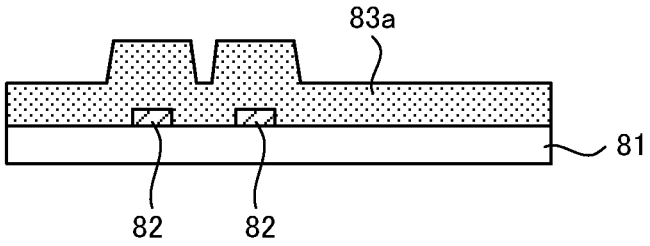
FIG. 10D is a cross-sectional diagram showing a fourth step of the manufacturing method of the toner sensor according to the embodiment of the present disclosure.

Subsequently, in a fourth step shown in FIG. 10D, the resist film 89 is removed, and an insulating resin layer 83*a* for protecting the coil 82 is formed all over the front surface.

Figure 10E:
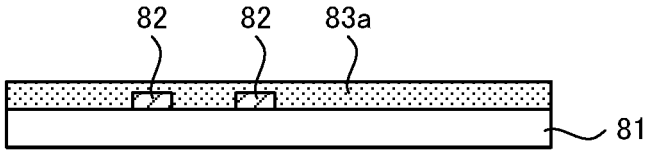
FIG. 10E is a cross-sectional diagram showing a fifth step of the manufacturing method of the toner sensor according to the embodiment of the present disclosure.

Subsequently, in a fifth step shown in FIG. 10E, flattening of the insulating resin layer 83*a* is performed by, for example, the CMP (Chemical Mechanical Polish) technology.

Figure 10F:
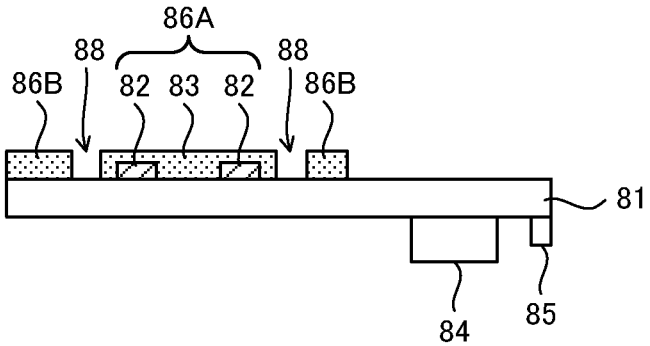
FIG. 10F is a cross-sectional diagram showing a sixth step of the manufacturing method of the toner sensor according to the embodiment of the present disclosure.

Finally, in a sixth step shown in FIG. 10F, an opening portion (the gap 88) is formed in the insulating resin layer 83*a*, and portions of the insulating resin layer 83*a* that are outside the facing region are removed. This forms the first contact portion 86A and the second contact portion 86B on the front surface of the substrate 81, wherein the first contact portion 86A is composed of the coil 82 and the protective film 83, and the second contact portion 86B is separated from the first contact portion 86A by a predetermined distance (namely, by the gap 88). In addition, the circuit portion 84 and the connector portion 85 are provided on a back surface (the second surface) of the substrate 81. With the above-described steps, the toner sensor 80 is manufactured such that the plurality of contact portions (the first contact portion 86A and the second contact portion 86B) having the same height are formed on the front surface of the substrate 81 in the facing region of the toner sensor 80.

It is noted that a manufacturing method of the toner sensor 80 is not limited to the above-described one. For example, the second contact portion 86B may be formed in a manufacturing step different from the manufacturing step of the protective film 83. That is, for example, the second contact portion 86B may be formed independently after the protective film 83 is formed.

Figure 11A:
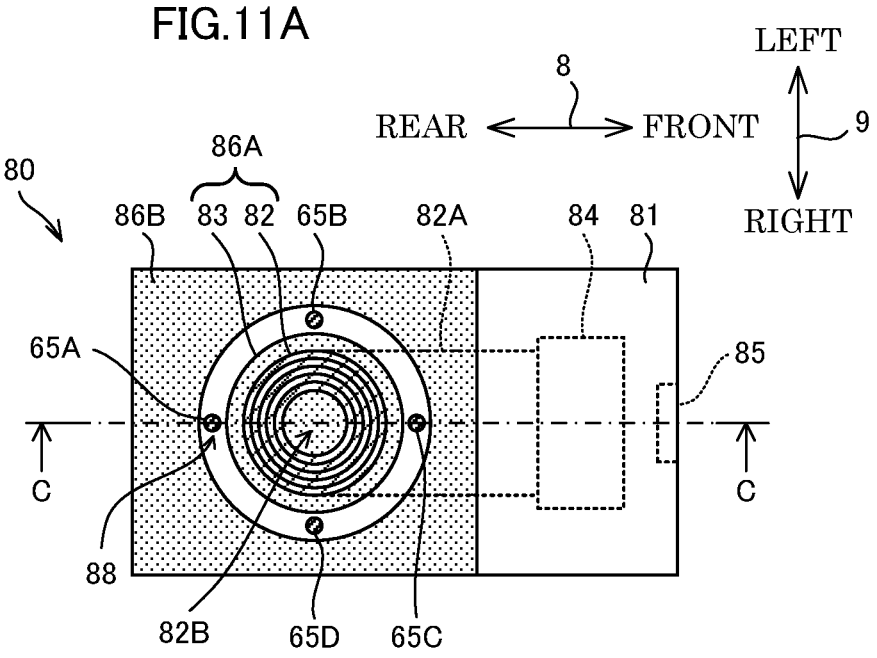
FIG. 11A is a plan diagram showing a configuration of the toner sensor according to the embodiment of the present disclosure.
Figure 11B:
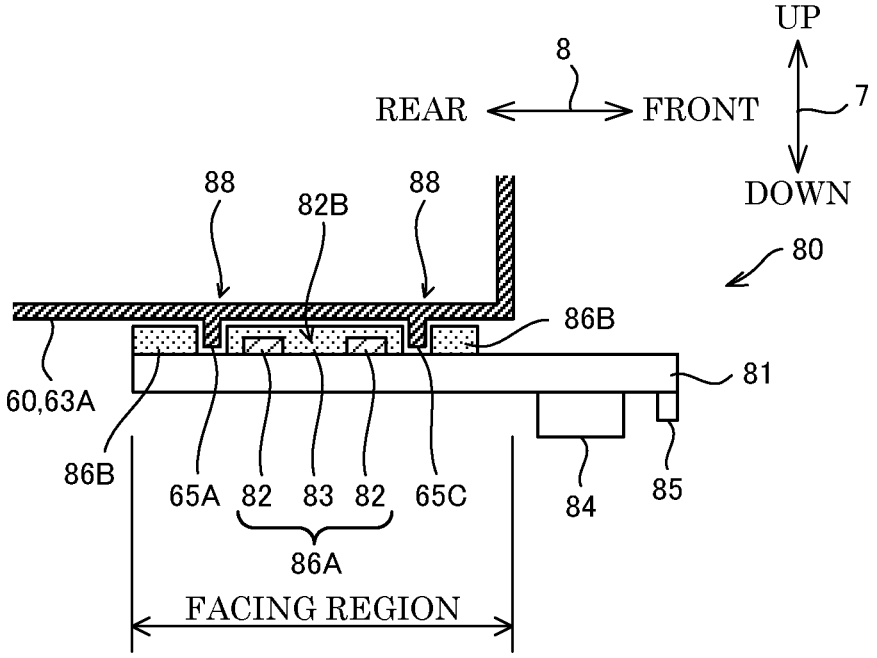
FIG. 11B is a cross-sectional diagram taken along a C-C line shown in FIG. 11A.

Here, the gap 88 (see FIG. 7A, FIG. 7B, FIG. 9A, and FIG. 9B) has a function to prevent a positional displacement of the toner sensor 80 with respect to the developing device 34 in the horizontal direction (the front-rear direction 8 and the left-right direction 9 in FIG. 7A and FIG. 7B). Specifically, as shown in FIG. 11A and FIG. 11B, the developing device 34 of the present embodiment may include one or more projection portions 65 (an example of a projection portion of the present disclosure) on the bottom surface of the developer reserving portion 63A. In the example shown in FIG. 11A and FIG. 11B, four projection portions 65A to 65D are formed on the housing 60 (the bottom surface of the developer reserving portion 63A). Each of the projection portions 65A to 65D is smaller in width than the gap 88, and is received in the gap 88 when the toner sensor 80 is attached to the housing 60 (the developer reserving portion 63A).

With the configuration shown in FIG. 11, for example, when a force in the front-rear direction 8 or the left-right direction 9 is applied to the toner sensor 80 in a state of being attached to the developer reserving portion 63A, the movement of the projection portions 65A to 65D is restricted in the gap 88, and thereby the movement of the toner sensor 80 in the front-rear direction 8 or the left-right direction 9 is restricted. This makes it possible to prevent a positional displacement in the horizontal direction of the toner sensor 80 with respect to the developer reserving portion 63A, and thus it is possible to fix the toner sensor 80 to the developer reserving portion 63A in a reliable manner. Accordingly, it is possible to restrict the detection values of the toner sensor 80 from varying.

[Magnetic Shield 87]

Meanwhile, the toner sensor 80 is required to be small so as not to interfere with inner components of the image forming apparatus 100. However, when the toner sensor 80 is made small, the coil 82 becomes small and sufficient magnetic flux density cannot be obtained. This makes it difficult to detect accurate magnetic permeability of the developer, causing a problem that the detection accuracy of the concentration of the toner is decreased. On the other hand, the image forming apparatus 100 according to the present embodiment prevents the detection accuracy of the concentration of the toner from decreasing even in a case where the toner sensor 80 is made small.

Figure 12A:
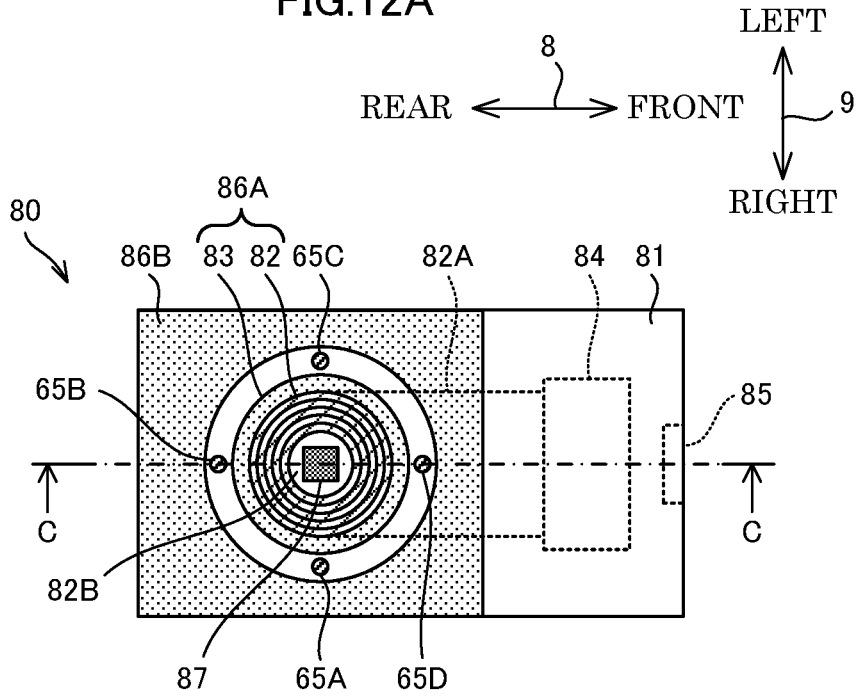
FIG. 12A is a plan diagram showing a configuration of the toner sensor according to the embodiment of the present disclosure.
Figure 12B:
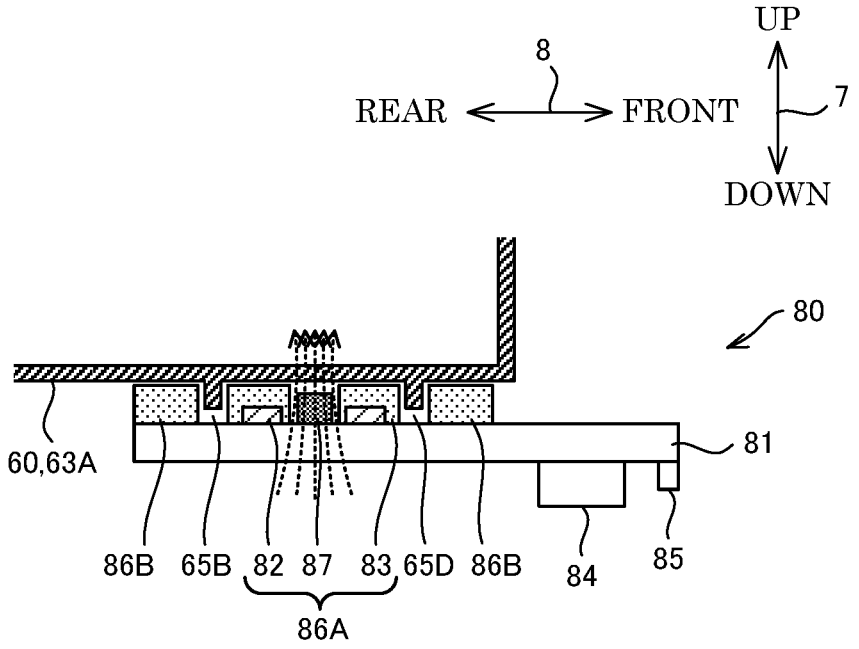
FIG. 12B is a cross-sectional diagram taken along a C-C line shown in FIG. 12A.

Specifically, in the image forming apparatus 100 according to the present embodiment, the toner sensor 80 further includes a magnetic shield 87. The magnetic shield 87 is an example of a first magnetic member of the present disclosure. The coil 82 is formed in a spiral shape extending from its center part outward, and a space 82B is formed at the center part. As shown in FIG. 12A and FIG. 12B, the protective film 83 is not formed on the space 82B, and the front surface (the first surface) of the substrate 81 is exposed. The magnetic shield 87 is provided on the front surface of the substrate 81 in the space 82B. For example, after the toner sensor 80 is manufactured, in the space 82B, the magnetic shield 87 is adhered and fixed to the front surface of the substrate 81 by double-sided tape. The height of the magnetic shield 87 from the substrate 81 is smaller than that of the plurality of portions (the first contact portion 86A, the second contact portion 86B). It is noted that FIG. 12A and FIG. 12B correspond to the configuration the toner sensor 80 and the developer reserving portion 63A shown in FIG. 9.

With the above-described configuration in which the magnetic shield 87 is provided at the center part of the coil 82, loss due to eddy current of the coil 82 is reduced, and magnetic flux density is increased. This makes it possible to increase the sensor sensitivity. In addition, with the above-described configuration in which the magnetic shield 87 is provided only at the center part of the coil 82 where the magnetic flux density is highest, it is possible to collect the magnetic flux efficiently and increase the sensor sensitivity. In addition, provision of the magnetic shield 87 makes it possible to suppress the influence of other metal components, thereby making it possible to displace other metal components in the vicinity of the toner sensor 80. Accordingly, even in a case where the toner sensor 80 is made small, it is possible to prevent decrease in detection accuracy of the concentration of the toner.

Figure 13A:
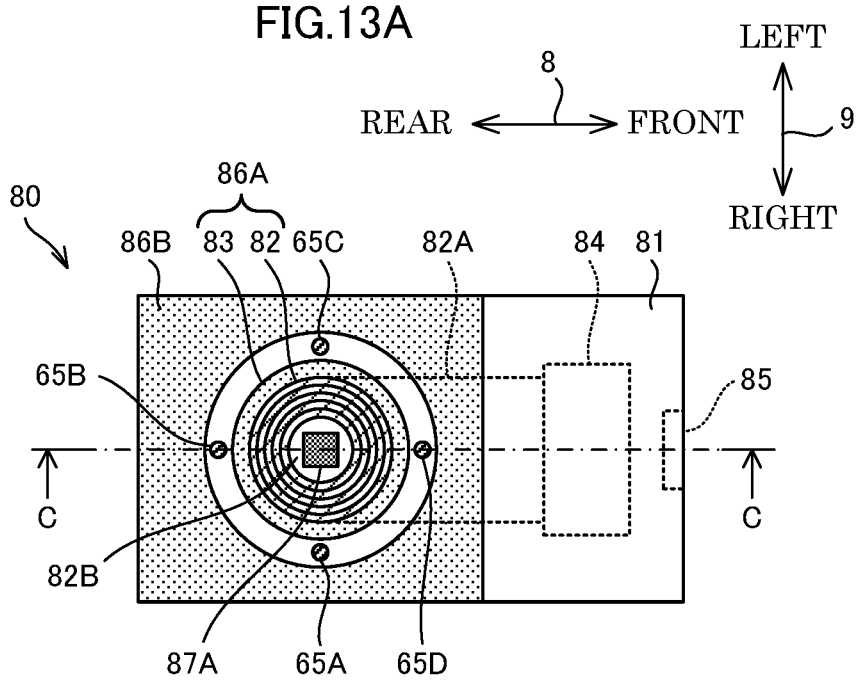
FIG. 13A is a plan diagram showing a configuration of the toner sensor according to the embodiment of the present disclosure.
Figure 13B:
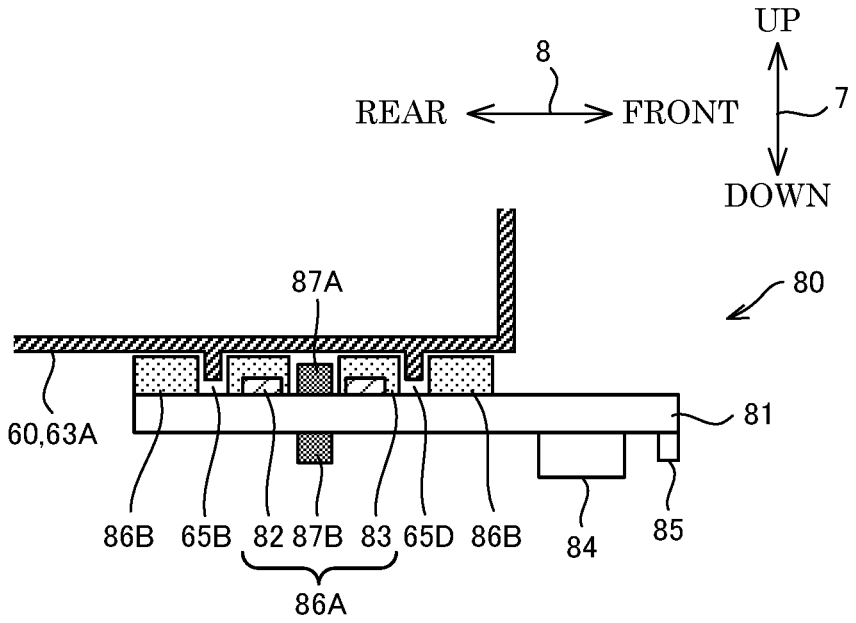
FIG. 13B is a cross-sectional diagram taken along a C-C line shown in FIG. 13A.

The image forming apparatus 100 is not limited to the configuration shown in FIG. 12A and FIG. 12B. For example, as shown in FIG. 13A and FIG. 13B, a magnetic shield 87A may be provided on the front surface (the first surface) of the substrate 81, and a magnetic shield 87B may be provided on the back surface (the second surface) of the substrate 81. The magnetic shield 87A is an example of a first magnetic member of the present disclosure, and the magnetic shield 87B is an example of a second magnetic member of the present disclosure. The magnetic shield 87A is provided at the center part (the space 82B) of the coil 82, and the magnetic shield 87B is provided at a position corresponding to the center part of the coil 82 on an opposite side from the magnetic shield 87A. This makes it possible to further increase the magnetic flux density, thereby making it possible to increase the sensor sensitivity and the detection accuracy of the concentration of the toner.

As described above, in the image forming apparatus 100 according to the present embodiment, the magnetic seal may be provided on the front surface of the substrate 81, or may be provided on both the front surface and the back surface of the substrate 81. In addition, the magnetic shield may be provided at a position that corresponds to the center part (the space 82B) of the coil 82.

Figure 14:
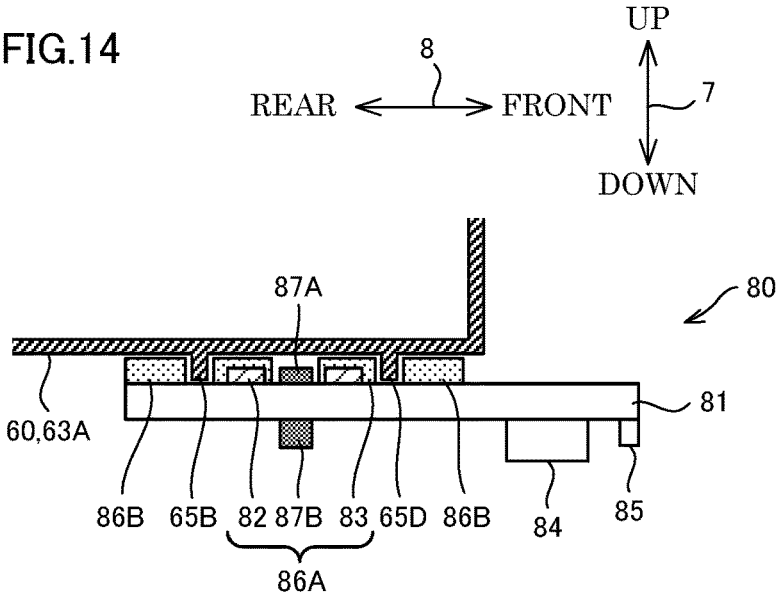
FIG. 14 is a cross-sectional diagram showing a configuration of the toner sensor according to the embodiment of the present disclosure.

Here, if the magnetic shield 87A is thick, the distance between the coil 82 and the developer reserving portion 63A is large, and the detection accuracy of the concentration of the toner may be decreased. In view of this, as shown in FIG. 14, the magnetic shield 87A may be made thin, and the magnetic shield 87B may be made thick. This makes it possible to increase the detection accuracy of the concentration of the toner while keeping high magnetic flux density. It is noted that the magnetic shield 87B may be made larger in width than the magnetic shield 87A.

Figure 15:
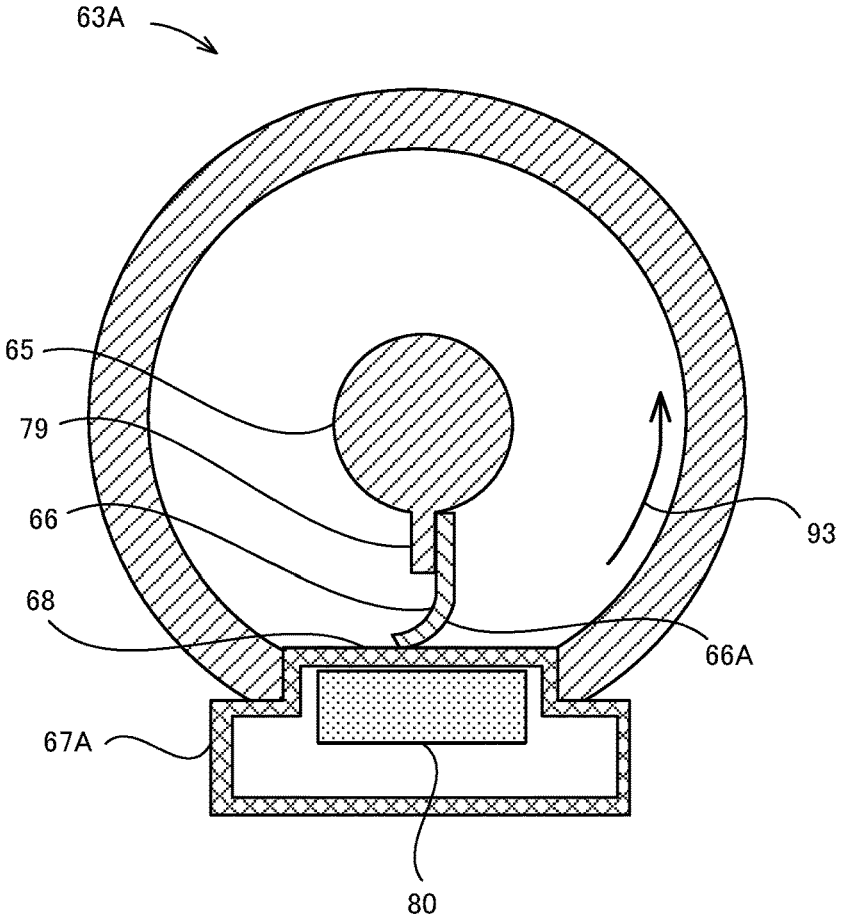
FIG. 15 is a cross-sectional diagram showing a configuration of a developer reserving chamber and the toner sensor according to the embodiment of the present disclosure.

In the above-described embodiment, as shown in FIG. 15, the toner sensor 80 may be stored in a casing 67A whose upper surface is flat. FIG. 15 is a cross-sectional diagram of the developer reserving portion 63A. According to the configuration shown in FIG. 15, an opening passing through a bottom wall of the developer reserving portion 63A is formed at the bottom surface of the developer reserving portion 63A, and the casing 67A is fitted in the opening. With this configuration, the flat, upper surface of the casing 67A is disposed inside the bottom surface of the developer reserving portion 63A.

In addition, a scraper 66 may be attached to the screw feeder 64A. The scraper 66 is an elastic, plate-like member formed from, for example, polyethylene terephthalate film. The scraper 66 is attached to a support portion 79 of the screw feeder 64A by, for example, double-sided tape. With this configuration, when the screw feeder 64A is rotated in the normal rotational direction (indicated by the arrow 93) during developing, the scraper 66 moves in the normal rotational direction, and a contact surface 66A of the scraper 66 comes in contact with the upper surface (the detection surface 68) of the casing 67A and abuts on the second seal portion 68 with buckling deformation. The scraper 66 removes the developer that has adhered to the upper surface (the detection surface 68) of the casing 67A. With this configuration, the developer that has stagnated at the upper surface (the detection surface 68) of the casing 67A is scraped off in the normal rotational direction each time the scraper 66 makes one rotation.

With the configuration shown in FIG. 15, it is possible to detect the concentration of the toner on the detection surface 68 accurately. In the configuration shown in FIG. 15, the toner sensor 80 is fixed in contact with the inner surface of the upper portion of the casing 67A. That is, the upper portion of the casing 67A is an example of a contacted portion of the present disclosure.

In addition, the above-described embodiment describes as one example the developing device 34 that uses two-component developer. However, the present disclosure is applicable to the image forming apparatus 100 that includes a developing device that uses one-component developer.

The scope of the present disclosure is defined not by the detailed description that precedes claims, but by the claims recited in an accompanying document. Accordingly, the embodiments described in the present specification should be understood as mere examples and to be not limitative. All changes or equivalents that fall within the scope of the claims are thus included in the scope of the claims.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a developer case storing developer; and a developer detection sensor disposed in contact with a contacted portion that is located near the developer stored in the developer case, and configured to detect magnetic permeability of the developer, wherein the developer detection sensor includes a substrate and, in a facing region on a first surface of the substrate that faces the contacted portion, a plurality of contact portions that are configured to come in contact with the contacted portion, a first contact portion that is one of the plurality of contact portions includes a detection portion configured to detect magnetism of the developer, the detection portion is a coil formed as a pattern in a planar shape, the first contact portion includes the coil and a protective film that covers the coil, and one or more second contact portions that are among the plurality of contact portions, excluding the first contact portion, are formed from a same material as the protective film.

2. The image forming apparatus according to claim 1, wherein the plurality of contact portions have a same height from the substrate.

3. The image forming apparatus according to claim 1, wherein the protective film and the one or more second contact portions are formed in a same manufacturing process.

4. The image forming apparatus according to claim 1, wherein the contacted portion is disposed on an outer surface of the developer case, and the developer detection sensor is fixed in a state of being in contact with the outer surface of the developer case.

5. An image forming apparatus comprising:

a developer case storing developer; and a developer detection sensor disposed in contact with a contacted portion that is located near the developer stored in the developer case, and configured to detect magnetic permeability of the developer, wherein the developer detection sensor includes a substrate and, in a facing region on a first surface of the substrate that faces the contacted portion, a plurality of contact portions that are configured to come in contact with the contacted portion, a first contact portion that is one of the plurality of contact portions includes a detection portion configured to detect magnetism of the developer, the contacted portion includes at least one projection portion that is received in a gap formed between the first contact portion and a second contact portion that are adjacent to each other, the second contact portion being one of the plurality of contact portions, and the projection portion is received in the gap when the developer detection sensor is in contact with the contacted portion.

6. The image forming apparatus according to claim 5, wherein the plurality of contact portions have a same height from the substrate.

7. The image forming apparatus according to claim 5, wherein the detection portion is a coil formed as a pattern in a planar shape.

8. The image forming apparatus according to claim 7, wherein the first contact portion includes the coil and a protective film that covers the coil, and one or more second contact portions that are among the plurality of contact portions, excluding the first contact portion, are formed from a same material as the protective film.

9. The image forming apparatus according to claim 8, wherein the protective film and the one or more second contact portions are formed in a same manufacturing process.

10. The image forming apparatus according to claim 5, wherein in a plan view, the gap is formed in an annular shape to surround the first contact portion.

11. The image forming apparatus according to claim 5, wherein the contacted portion is disposed on an outer surface of the developer case, and the developer detection sensor is fixed in a state of being in contact with the outer surface of the developer case.

12. An image forming apparatus comprising:

a developer case storing developer; and a developer detection sensor disposed in contact with a contacted portion that is located near the developer stored in the developer case, and configured to detect magnetic permeability of the developer, wherein the developer detection sensor includes a substrate and, in a facing region on a first surface of the substrate that faces the contacted portion, a plurality of contact portions that are configured to come in contact with the contacted portion, a first contact portion that is one of the plurality of contact portions includes a detection portion configured to detect magnetism of the developer, the detection portion is a coil formed in a spiral shape extending from its center part outward, and a magnetic member is provided on the first surface of the substrate, or on both the first surface and a second surface that is opposite from the first surface, at a position that corresponds to the center part.

13. The image forming apparatus according to claim 12, wherein the plurality of contact portions have a same height from the substrate.

14. The image forming apparatus according to claim 12, wherein the spiral shape is a planar shape.

15. The image forming apparatus according to claim 14, wherein the first contact portion includes the coil and a protective film that covers the coil, and one or more second contact portions that are among the plurality of contact portions, excluding the first contact portion, are formed from a same material as the protective film.

16. The image forming apparatus according to claim 15, wherein the protective film and the one or more second contact portions are formed in a same manufacturing process.

17. The image forming apparatus according to claim 12, wherein a gap is formed between the first contact portion and a second contact portion that are adjacent to each other, and in a plan view, the gap is formed in an annular shape to surround the first contact portion.

18. The image forming apparatus according to claim 12, wherein the contacted portion is disposed on an outer surface of the developer case, and the developer detection sensor is fixed in a state of being in contact with the outer surface of the developer case.

* * * * *